US006222146B1

(12) United States Patent
Türkmen

(10) Patent No.: US 6,222,146 B1
(45) Date of Patent: Apr. 24, 2001

(54) ARC EXTINGUISHING CHAMBER FOR LOW VOLTAGE POWER SWITCHES

(75) Inventor: Sezai Türkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/214,887

(22) PCT Filed: Jul. 9, 1997

(86) PCT No.: PCT/DE97/01474

§ 371 Date: Oct. 20, 1999

§ 102(e) Date: Oct. 20, 1999

(87) PCT Pub. No.: WO98/02893

PCT Pub. Date: Jan. 22, 1998

(30) Foreign Application Priority Data

Jul. 15, 1996 (DE) ..... 296 12 636

(51) Int. Cl.[7] ..... H01H 33/02

(52) U.S. Cl. ..... 218/149; 200/306; 335/201; 218/156

(58) Field of Search ..... 200/304, 306; 218/34, 35, 149–151, 155–158; 335/201, 202

(56) References Cited

U.S. PATENT DOCUMENTS

| | | | | |
|---|---|---|---|---|
| 4,388,506 | * | 6/1983 | Murai et al. | 218/156 |
| 4,876,424 | * | 10/1989 | Leone et al. | 218/155 X |
| 5,756,951 | * | 5/1998 | Manthe et al. | 218/35 |

FOREIGN PATENT DOCUMENTS

| | | |
|---|---|---|
| 75 22 823 | 1/1977 | (DE) . |
| 34 02 836 | 8/1985 | (DE) . |
| 35 41 514 | 5/1987 | (DE) . |
| 44 10 108 | 9/1995 | (DE) . |
| 0 225 207 | 6/1987 | (EP) . |

* cited by examiner

*Primary Examiner*—J. R. Scott
(74) *Attorney, Agent, or Firm*—Kenyon & Kenyon

(57) ABSTRACT

An arc quenching chamber for low-voltage circuit breakers has a quenching chamber enclosure and a quenching chamber cover, which is detachably attached to the quenching chamber enclosure by fastening elements. Opposite a hollow extension the quenching chamber enclosure has a nose which may be gripped by a claw-like extension of the quenching chamber cover. Another method of fastening the quenching chamber cover involves lateral nose-like webs on the quenching chamber enclosure and projections on both sides of the quenching chamber cover to grip the noses.

6 Claims, 2 Drawing Sheets

ARC EXTINGUISHING CHAMBER FOR LOW VOLTAGE POWER SWITCHES

FIELD OF THE INVENTION

The present invention relates to arc quenching chambers for air-break low-voltage circuit breakers, in particular reducing the connecting elements required for their assembly.

BACKGROUND INFORMATION

Air-break low-voltage circuit breakers need an arc quenching chamber to quench any arcs that occur without impairment of the circuit breaker and adjacent system parts or other components, otherwise, there is a risk that the hot arc gases, which are thus ionized, might cause an electric sparkover or other damage.

Arc quenching chambers can be manufactured only as separate units, in particular for large circuit breakers. The purpose of the arc quenching chambers' connection to the main body of the circuit breaker and connection of individual parts to one another is to seal technically necessary gaps and joints to prevent passage of ionized arc gases and prevent electric sparkover due to any gases that escape nevertheless. In this regard, special attention should also be devoted to the connection of the quenching chamber cover to its housing.

U.S. Pat. No. 4,388,506 describes a quenching chamber which is arranged removably on an air-break circuit breaker.

A quencher is inserted into a groove on a side of a stationary contact by using a hook-like extension and is secured with screws on the side of the movable switch contact. However, quencher cover is attached to a housing of the quencher with four screws. With this switch, the hook-like extension serves to secure the entire quencher and also in particular to seal it against leakage of ionized arc gases.

German Patent No. 35 41 514 describes an arc quenching chamber with an attachment for further cooling of escaping gases. This attachment is mounted on the arc quenching chamber with a total of four screws. These screws pass through holes in a wall of a housing body of the arc quenching chamber, entering pockets that are open at a side. The pockets are designed to accommodate the dimensions of inserted nuts, so that the screws can engage in the nuts with their thread. This arc quenching chamber requires not only four fastening screws but is also complicated and expensive to manufacture, e.g., the pockets that are open at the side to accommodate the nuts.

European Patent Application No. 225 207 describes an arc quenching chamber where arc quenching plates are held between two side walls that are provided with ribs and grooves and have integrally molded half covers for a quencher with an insulating holder. With the help of screws and this holder, the half covers are attached to a bracket, which in turn serves for attachment to a breaker enclosure, which is done with the help of fastening screws. Apart from the multitude of individual parts of the quenching chamber per se, a plurality of fastening elements are needed to attach the quenching chamber to a breaker, namely four screws including washers per breaker pole for fastening the half covers to the two mounting brackets, two mounting brackets, and two screws with nuts for securing the mounting brackets to the breaker enclosure.

With other conventioal breakers, described in German Patent No. 44 10 108, the quenching chamber cover is attached to a quenching chamber enclosure with four screws.

The quenching chamber cover covers an extension of the quenching chamber enclosure in which a single fastening screw is accommodated as a captive screw mounting a complete arc quenching chamber on the circuit breaker. An insertion opening for a screwdriver is provided in the arc quenching chamber cover. Here again, a relatively large number of fastening elements are needed for fastening the quenching chamber cover to the quenching chamber and fastening the quenching chamber to the enclosure of the breaker.

SUMMARY OF THE INVENTION

An object of the present invention is to design an arc quenching chamber so that it may be assembled from its individual parts using simple means and a small number of connecting elements so that the requirements for joining of the individual parts, in particular sealing of technically required joints and gaps against leakage of ionized switching gases and preventing sparkover due to any gases which nevertheless escape, are met.

The object is achieved according to the present invention by providing a horizontal nose-like projection on a top edge of a quenching chamber enclosure on a front side of the quenching chamber opposite a projection, where a quenching chamber cover has a claw-like extension for gripping the noselike projection on the quenching chamber enclosure when the quenching chamber cover is placed on the quenching chamber enclosure and a bore hole for insertion of the fastening screws. The quenching chamber cover is secured in the quenching chamber enclosure with just one fastening screw, which is passed through the bore hole in the quenching chamber cover and a bore hole in the hollow extension of the quenching chamber enclosure, and is screwed into a corresponding thread provided in a circuit breaker.

In this embodiment of the quenching chamber, it is proven especially advantageous for the enclosure of the quenching chamber and the cover of the quenching chamber to be attached jointly to the circuit breaker with only a single screw.

According to the present invention, the object is also achieved by arranging horizontal nose-like projections on the top edge of the quenching chamber enclosure on the side walls adjacent to the quenching chamber enclosure, providing claw-like extensions on the quenching chamber cover for gripping these projections when the cover is pushed onto the quenching chamber enclosure, mounting an upward pointing projection on the top edge of the front side of the quenching chamber to limit a path of the quenching chamber cover in mounting, and arranging a stop bore in the quenching chamber cover so that the head of the fastening screw forms a stop for a wall of this stop bore for horizontal securing of the quenching chamber cover.

This embodiment forms a sliding guide for the quenching chamber cover which holds the quenching chamber cover securely on the quenching chamber enclosure as gas pressure is created by arcing gases, while at the same time it seals a joint between the quenching chamber and its cover to prevent the escape of arc gases. A head of the fastening screw provides a horizontal stop for the quenching chamber cover by its contact with the wall of the stop bore in the quenching chamber cover. However, this purpose may also be served by an additional angular element, which is held in the form of a washer by the fastening screw and forms a stop (instead of the stop being formed by the screw head) for the wall of the stop bore in the quenching chamber cover.

A through hole for insertion of a tool to manipulate the fastening screw is advantageously provided axially to the stop bore in the quenching chamber cover.

In addition to the through hole, an insertion opening is also advantageously provided in the quenching chamber cover for insertion of the fastening screw.

However, the stop bore in the quenching chamber cover may also be designed as a through hole with a uniform diameter.

The proposed embodiments for fastening the quenching chamber cover not only make it possible to minimize the total number of connecting and fastening elements needed to assemble the quenching chamber (for connecting the quenching chamber 30 cover to the quenching chamber enclosure) by using the screw provided for fastening the complete quenching chamber and also for connecting the quenching chamber cover to the quenching chamber enclosure, but they also guarantee that the requirements, sealing the technically required joints and gaps to prevent the passage of ionized arc gases by having form-fitting elements that support the quenching chamber cover against the gas pressure in switching and thus counteract the escape of these gases, are met. This embodiment permits simpler handling as well as a better sealing at the joint.

DETAILED DESCRIPTION

Figure 1:
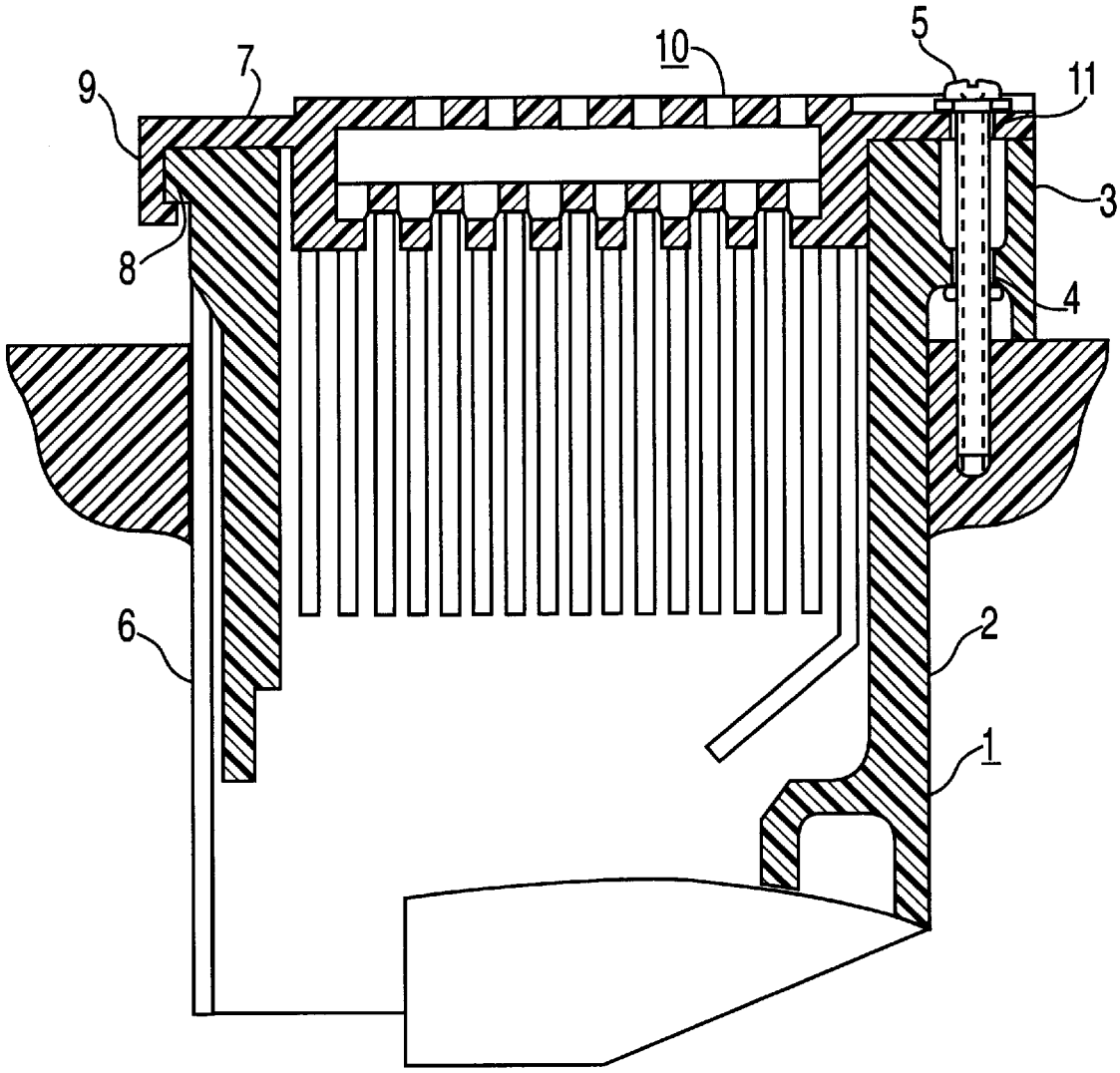
FIG. 1 shows a schematic of a section through a first embodiment of a quenching chamber according to the present invention.

Quenching chamber enclosure 1 shown in FIG. 1 as an example has on side 2, where it is attached to the circuit breaker, a hollow extension 3 in which there is a bore hole 4 to receive fastening screw 5. On an opposite front side 6, a horizontal nose-like projection 8 is arranged on top edge 7 of quenching chamber enclosure 1 so that a claw-like extension 9 of quenching chamber cover 10 grips it when quenching chamber cover 10 is placed on quenching chamber enclosure 1 and displaced along edge 7. Quenching chamber cover 10 is secured on quenching chamber enclosure 1 in an upward displaced position with the help of just one fastening screw 5 which is passed through a corresponding bore hole 11 in quenching chamber cover 10 and bore hole 4 in quenching chamber enclosure 1 and screwed into a matching thread provided in the circuit breaker.

Figure 2:
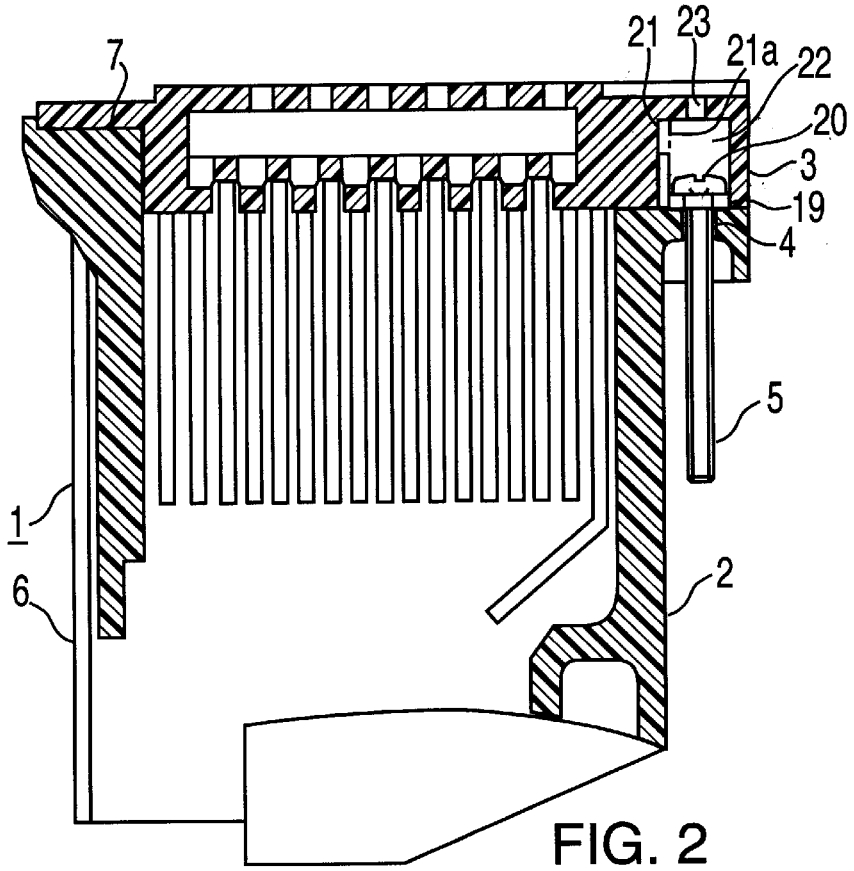
FIG. 2 shows a schematic of a section along line II—II shown in FIG. 3 of a second embodiment of a quenching chamber according to the present invention.
Figure 3:
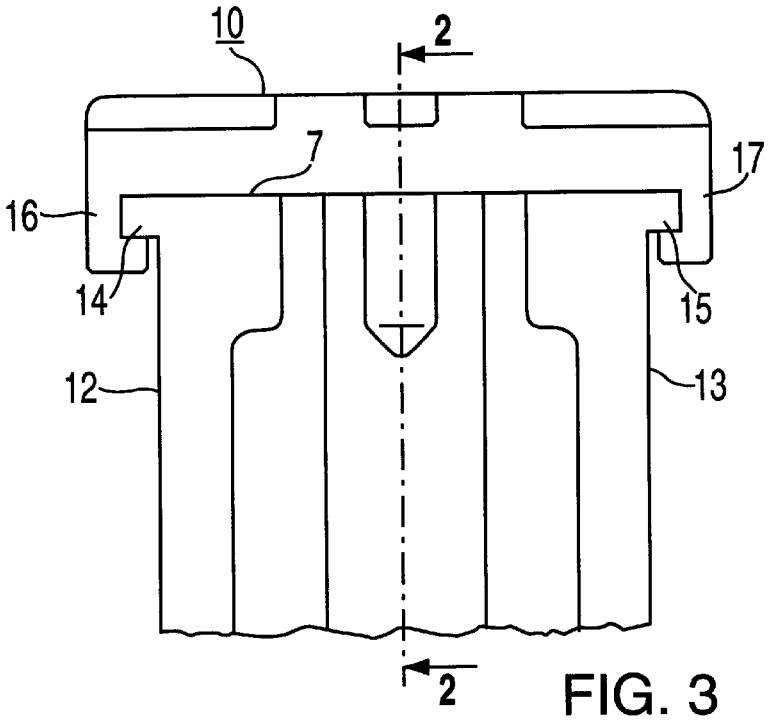
FIG. 3 shows a view of the quenching chamber shown in FIG. 2 from a side where it is jointed to a circuit breaker.

In a second embodiment shown as an example in FIG. 2, quenching chamber enclosure 1 also has a hollow extension 3 accommodating a bore hole 4 to receive fastening screw 5 on side 2 where the circuit breaker is attached. However, horizontal nose-like projections 14, 15 are arranged on top edge 7 of quenching chamber enclosure 1 on side walls 12, 13 adjacent to wall 2 of quenching chamber 1 so that they interact with claw-like extensions 16, 17 on quenching chamber cover 10. These extensions 16, 17 grip the nose-like projection 8 when the quenching chamber cover is pushed onto quenching chamber enclosure 1 from side 2 of the fastening on circuit breaker. A sliding guide is formed so that quenching chamber cover 10 is held securely on quenching chamber enclosure 1 when gas pressure occurs due to arc gases, while at the same time sealing a joint between quenching chamber enclosure 1 and quenching chamber cover 10 to prevent an escape of arc gases. A stop 18 pointing upward on top edge 7 of front side 6 of quenching chamber enclosure 1 forms a limit for the displacement path and also serves to provide a better sealing of the joint between quenching chamber enclosure 1 and quenching chamber cover 10 to prevent the escape of arc gases. Quenching chamber cover 10 is secured on quenching chamber enclosure 1 with the help of just one fastening screw 5 which passes through bore hole 4 in quenching chamber enclosure 1 and is screwed into a matching thread (not shown) in the circuit breaker. Head 20 of this fastening screw 5 in a stop bore 22 provides horizontal locking of quenching chamber cover 10. For this purpose, an additional angular element 19 is provided, which is held in the form of a washer by fastening screw 5 and forms a stop for wall 21a in stop bore 22 in hollow extension 3 of the quenching chamber cover (instead of the stop being formed by screw head 20). If screw head 20 is to form the stop, quenching chamber enclosure 1 will have a wall 21, indicated with a dash-dot line in FIG. 2.

A through hole 23 is provided in quenching chamber cover 10 axially with the stop bore for inserting a tool to manipulate the fastening screw.

The advantages of the embodiments according to the present invention include not only the small total number of connecting and fastening elements needed to assemble the quenching chamber (for joining the quenching chamber cover to the quenching chamber enclosure) by simultaneously using the screw provided for fastening the complete quenching chamber to also connect the quenching chamber cover to the quenching chamber enclosure, but also that the requirements with regard to sealing the technically required joints and gaps to prevent the escape of ionized arc gases are met by having form-fitting elements that support the quenching chamber cover against the gas pressure in switching and prevent the escape of these gases.

What is claimed is:

1. An arc quenching chamber for a low-voltage circuit breaker, comprising:

a quenching chamber enclosure having a first extension on a side for attaching to the circuit breaker, the first extension having a bore hole for receiving a fastening screw; and a quenching chamber cover attached to the quenching chamber enclosure, the quenching chamber enclosure having at least one horizontal nose-like projection on a top edge of at least one wall of the quenching chamber enclosure for attaching the quenching chamber cover to the quenching chamber enclosure, the quenching chamber cover having at least one claw-like extension for gripping the at least one horizontal nose-like projection and a bore hole aligned with the bore hole in the first extension of the chamber enclosure, the fastening screw extending through the aligned bore holes and into a matching thread of the circuit breaker.

2. The arc quenching chamber according to claim 1, wherein the at least one horizontal nose-like projection is arranged on the top edge of a front side of the quenching chamber enclosure opposite the first extension, and wherein the at least one claw-type extension is arranged opposite the quenching chamber cover so that the at least one claw-like extension grips the at least one nose-like projection when the quenching chamber cover is placed on the quenching chamber enclosure.

3. The arc quenching chamber according to claim 1, wherein at least one of the at least one horizontal nose-like projections is provided on a top edge of each side wall of the quenching chamber enclosure adjacent the side for attaching to the circuit breaker, the at least one clawlike extension being positioned to grip the at least one of the at least one horizontal nose-like projections when the quenching chamber enclosure cover is placed on the quenching chamber enclosure, wherein a top edge of a front side of the quenching chamber includes a projection pointing upward to limit a displacement path of the quenching chamber cover, and wherein the quenching chamber cover has a stop bore so that a head of the fastening screw forms a stop for a wall of the stop bore for horizontal securing of the quenching chamber cover.

4. The arc quenching chamber according to claim 2, wherein the quenching chamber cover has a through hole arranged axially with a stop bore for insertion of a tool to manipulate the fastening screw.

5. The arc quenching chamber according to claim 2, wherein the quenching chamber cover has an insertion opening for insertion of a tool to manipulate the fastening screw.

6. The arc quenching chamber according to claim 2, wherein the quenching chamber cover has a stop bore, the stop bore being a through hole with a constant diameter.

* * * * *